US009366500B1

(12) United States Patent
Lee

(10) Patent No.: US 9,366,500 B1
(45) Date of Patent: Jun. 14, 2016

(54) DIRECT SPRAY TYPE COMPRESSED AIR GUN

(71) Applicant: Si Young Lee, Seoul (KR)

(72) Inventor: Si Young Lee, Seoul (KR)

( * ) Notice: Subject to any disclaimer, the term of this patent is extended or adjusted under 35 U.S.C. 154(b) by 0 days.

(21) Appl. No.: 14/831,942

(22) Filed: Aug. 21, 2015

(30) Foreign Application Priority Data

Jul. 28, 2015 (KR) ..... 10-2015-0106329

(51) Int. Cl.
*F41B 11/723* (2013.01)
*F41B 11/68* (2013.01)
*F41A 19/14* (2006.01)

(52) U.S. Cl.
CPC ..... *F41B 11/68* (2013.01); *F41A 19/14* (2013.01); *F41B 11/723* (2013.01)

(58) Field of Classification Search
CPC ..... F41B 11/68; F41B 11/72; F41B 11/723
USPC ..... 42/68, 76, 72
See application file for complete search history.

(56) References Cited

U.S. PATENT DOCUMENTS 4,819,609 A * 4/1989 Tippmann ..... F41B 11/723 124/48
2012/0180772 A1* 7/2012 St. Phillips ..... F41B 11/723 124/73
2014/0060512 A1* 3/2014 Macy ..... F41B 11/62 124/73
2015/0198407 A1* 7/2015 Giannelli ..... F41B 11/83 124/76

* cited by examiner

*Primary Examiner* — Reginald Tillman, Jr.
(74) *Attorney, Agent, or Firm* — Cantor Colburn LLP

(57) ABSTRACT

A direct spray type compressed air gun includes: an air gun body having a handgrip mounted at the lower part thereof; a gun barrel mounted at front side of the air gun body; a compressed-air cylinder mounted at the rear side of the air gun body; a valve part spaced apart from the rear end of the gun barrel; a barrel holder for fixing the gun barrel to the air gun body; a hammer part inserted into the rear end part of the gun barrel; a spring mounted between the hammer part and the barrel holder; a hammer moving part mounted at the rear end of the hammer part; a latch part mounted on the air gun body to block movement of the hammer part; a trigger part mounted on the air gun body and presses the latch part; and a loading lever part joined with the hammer moving part.

11 Claims, 8 Drawing Sheets

(a)

(b)

(c)

DIRECT SPRAY TYPE COMPRESSED AIR GUN

BACKGROUND OF THE INVENTION

1. Field of the Invention

The present invention relates to an air gun, and, more particularly, to a direct spray type compressed air gun in which highly-compressed air of a fixed quantity is sprayed in the direction of a projectile and the projectile is propelled at high speed when a hammer part directly strikes a valve collar.

2. Background Art

In general, an air gun propels a bullet using compressed air which is stored in a compressed-air cylinder. The air compressed in the compressed-air cylinder is controlled to be emitted out by a fixed quantity in virtue of a valve mounted at an inlet of the compressed-air cylinder, and the bullet is propelled by virtue of the compressed air emitted.

In this instance, air charged at high pressure is needed in order to propel a heavy projectile, namely, a bullet, at high speed, and the valve needs a relatively strong impact in order to discharge air of high pressure. Moreover, in order to apply such a strong impact to the valve, a heavy hammer and a compression spring of a strong power are needed.

However, an air gun which has the heavy hammer and the compression spring of the strong power needs a great deal of power for a loading action to move the heavy hammer to a predetermined distance against an elastic force of the compression spring in order to apply an impact to the valve.

Nevertheless, conventional direct spray type compressed air guns have a problem in that it is difficult for users to load the gun because loading means for moving the hammer to a loading position is mounted in a very small size on a side of the air gun.

SUMMARY OF THE INVENTION

Accordingly, the present invention has been made to solve the above-mentioned problems occurring in the prior arts, and it is an object of the present invention to provide a direct spray type compressed air gun which can move a hammer part to a loading position by virtue of an action to bend a loading lever part back by a small power and in which highly-compressed air of a fixed quantity is sprayed in the direction of a projectile and the projectile is propelled at high speed when the hammer part moved to the loading position directly strikes a valve collar.

To accomplish the above object, according to the present invention, there is provided a direct spray type compressed air gun including: an air gun body which has a handgrip mounted at the lower part thereof; a gun barrel which is mounted at the front side of the air gun body; a compressed-air cylinder which is mounted at the rear side of the air gun body to store compressed air; a valve part which is spaced apart from the rear end of the gun barrel at a predetermined interval to spray the fixed quantity of the compressed air stored in the compressed-air cylinder in the direction of the gun barrel by an external impact; a barrel holder for fixing the gun barrel to the air gun body in such a way that a part of the rear end of the gun barrel is exposed; a hammer part which is inserted into the rear end part of the gun barrel and mounted to slide along the gun barrel, and which applies impact to the valve part to spray the compressed air and blocks a space between the valve part and the gun barrel to guide the compressed air to move in the direction of the gun barrel; a spring which is mounted between the hammer part and the barrel holder to press the hammer part in the direction of the valve part; a hammer moving part which is mounted at the rear end of the hammer part to be able to slide and pushes the hammer part in the direction of the barrel holder; a latch part which is mounted on the air gun body to block movement of the hammer part in a state where the hammer part is moved in a loading position; a trigger part which is mounted on the air gun body and presses the latch part to release the blocked state of the hammer part; and a loading lever part which is joined with the hammer moving part to make the hammer moving part slide to the loading position and a discharge position.

Moreover, the valve part includes: a valve body which is mounted at an inlet of the compressed-air cylinder and has a spray tube of a predetermined length in the direction of the gun barrel; a blocking part which is mounted inside the valve body to block an inner diameter of the valve body; and a valve collar which is mounted at the rear end of the valve body and reverses by an external impact to temporarily open the blocking part.

Furthermore, the hammer part includes: a cylindrical hammer body having a barrel hole formed at the center thereof; a small diameter part which is formed by the barrel hole extended to the rear end of the hammer body and has a diameter smaller than that of the hammer body, so that the hammer moving part is fit onto the outside of the small diameter part to be able to slide; and a latch insertion groove which is engraved on the lower side of the hammer body and to which an end of the latch part is inserted to prevent movement of the hammer part.

Additionally, a diameter of the barrel hole has the size that the valve body and the small diameter part come into contact with each other as much as possible.

In addition, the hammer moving part has a tubular shape having an inner diameter in which the small diameter part is inserted.

Moreover, the loading lever part includes: a the rotary lever which is mounted at the lower part of the air gun body to rotate on the lever rotary shaft; and a connection driving part which is connected with the rotary lever and the lower part of the hammer moving part and moves the hammer moving part to the loading position and the discharge position by virtue of the rotational operation of the rotary lever.

Furthermore, the trigger part includes: a trigger plate which is rotatably mounted on a trigger rotary shaft mounted near to a lever rotary shaft; a trigger which is fixed and mounted at the rear end of the trigger plate; and a pressing head which is fixed and mounted at an end of the trigger plate which is opposed to the trigger and lowers by a pulling action of the trigger to press the latch part.

Additionally, a driving part mounting hole is formed at the center of the trigger plate to allow the connection driving part to operate in the inserted state without interference.

Moreover, the latch part includes: a latch plate rotatably connected to the trigger rotary shaft; a blocking head which is formed on the upper side of the latch plate and is inserted into the latch insertion groove; a pressed part which is formed at the lower side of the latch plate to be pressed by the pressing head; and an elasticity means which is mounted at the latch plate to press the latch plate whenever an external force does not exist.

Furthermore, the latch part further includes a safety lever which is formed on a side of the latch plate opposed to the blocking head to restrict a rotational operation of the trigger plate.

Additionally, the loading lever part further includes an automatic locking lever which is rotatably mounted on the rotary lever to prevent rotation from the loading position of the rotary lever to the discharge position.

According to the present invention, the direct spray type compressed air gun can move the hammer part to a loading position by virtue of an action to bend the loading lever part back by a small power, and sprays highly-compressed air of a fixed quantity in the direction of the projectile and propels the projectile at high speed when the hammer part moved to the loading position directly strikes the valve collar.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, reference will be now made in detail to the preferred embodiment of the present invention with reference to the attached drawings.

Figure 1:
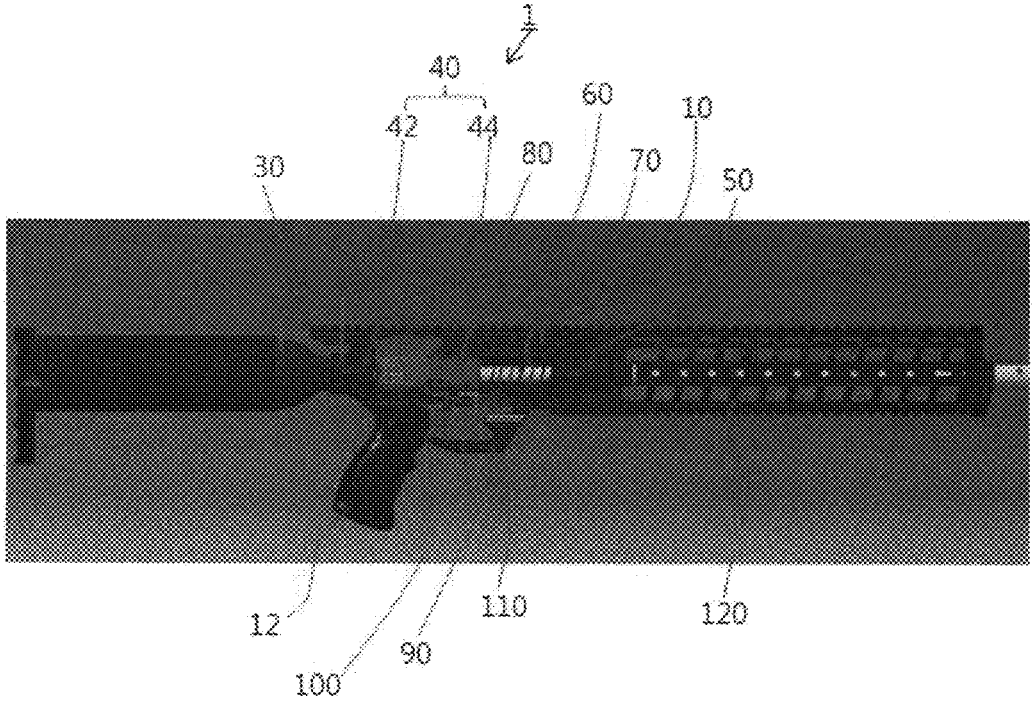
FIG. 1 is a partially open diagram showing a structure of a direct spray type compressed air gun according to a preferred embodiment of the present invention.

As shown in FIG. 1, a direct spray type compressed air gun 1 according to a preferred embodiment of the present invention includes an air gun body 10, a gun barrel 20, a compressed-air cylinder 30, a valve part 40, a barrel holder 50, a hammer part 60, a spring 70, a hammer moving part 80, a latch part 90, a trigger part 100 and a loading lever part 110.

First, as shown in FIG. 1, the air gun body 10 has a structure that a handgrip 12 is mounted at the lower part and a space in which other components will be mounted is formed at the upper part. Therefore, in this embodiment, the air gun body 10 can be varied into various shapes.

Next, as shown in FIG. 1, the gun barrel 20 is mounted at the front side of the air gun body 10 and serves as a path through which a projectiles, namely, a bullet, discharged from the air gun 1 according to the preferred embodiment of the present invention passes while being discharged. In this embodiment, the rear end of the gun barrel 20 is mounted inside the air gun body 10 and the front end is formed frontward long and gets out of the air gun body 10.

As shown in FIG. 1, the gun barrel 20 is fixed and mounted on the air gun body 10 by the barrel holder 50. The barrel holder 50 may have one of various structures to fix the gun barrel 20. For instance, as shown in FIG. 1, the barrel holder 50 may be in a ring which generally surrounds the outer face of one side of the gun barrel 20.

Next, as shown in FIG. 1, the compressed-air cylinder 30 is mounted at the rear side of the air gun body 10 to store compressed air. In this instance, an inlet of the compressed-air cylinder 30 to discharge the compressed air is mounted in the direction to accurately coincide with an end of the gun barrel 20. Moreover, the compressed-air cylinder 30 may further include a butt plate mounted at the rear end thereof.

Next, as shown in FIG. 1, the valve part 40 is mounted at the front end of the compressed-air cylinder 30 to control the compressed air stored in the compressed-air cylinder 30 to be discharged in a fixed quantity. Furthermore, in this embodiment, the valve part 40 is spaced apart from the rear end of the gun barrel 20 at a predetermined interval to spray the fixed quantity of the compressed air stored in the compressed-air cylinder 30 in the direction of the gun barrel by an external impact.

Figure 3:
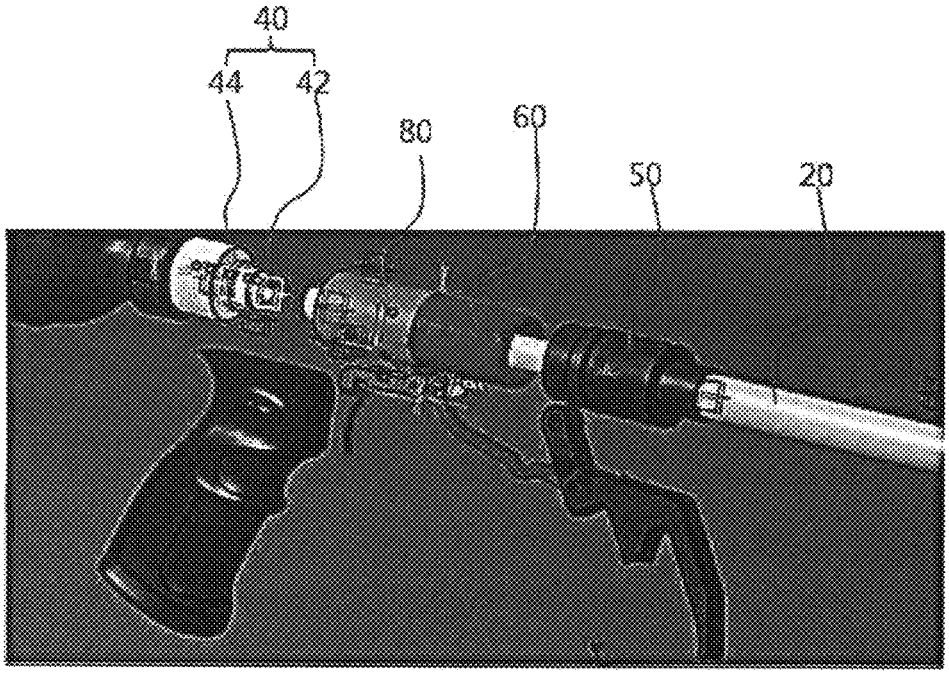
Figure 4:
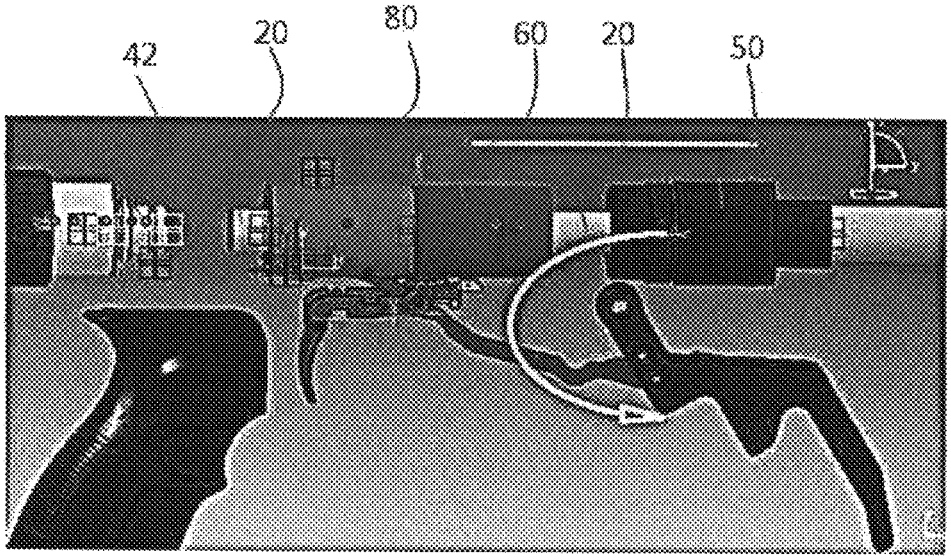

In detail, as shown in FIGS. 3 and 4, the valve part 40 includes a valve body 42, a blocking part (not shown in the drawings) and a valve collar 44. First, the valve body 42 is joined to the inlet of the compressed-air cylinder 30 and forms a general outward appearance of the valve part 40. Additionally, the front end of the valve body 42 has a long tube form to guide the path through which the compressed air is discharged, the front end of the valve body 42 and the rear end of the gun barrel are mounted in the direction that they accurately coincide with each other.

Next, the blocking part is mounted inside the valve body to regulate an opening part of the valve body 42. The valve collar 44 is mounted outside the valve body 42 in a ring shape to be connected with the blocking part to temporarily open the blocking part while reversing by an external impact.

Next, as shown in FIG. 1, the hammer part 60 is inserted into the rear end part of the gun barrel 20 and is mounted to slide along the gun barrel 20, applies impact to the valve part 40 to spray the compressed air and blocks a space between the valve part 40 and the gun barrel 20 to guide the compressed air to move in the direction of the gun barrel 20. That is, in this embodiment, the hammer part 60 strikes the valve collar 44 to spray the compressed air for propelling the projectile and serves to guide the sprayed compressed air to move in the direction of the projectile loaded on the gun barrel 20 without leaks.

Figure 5:
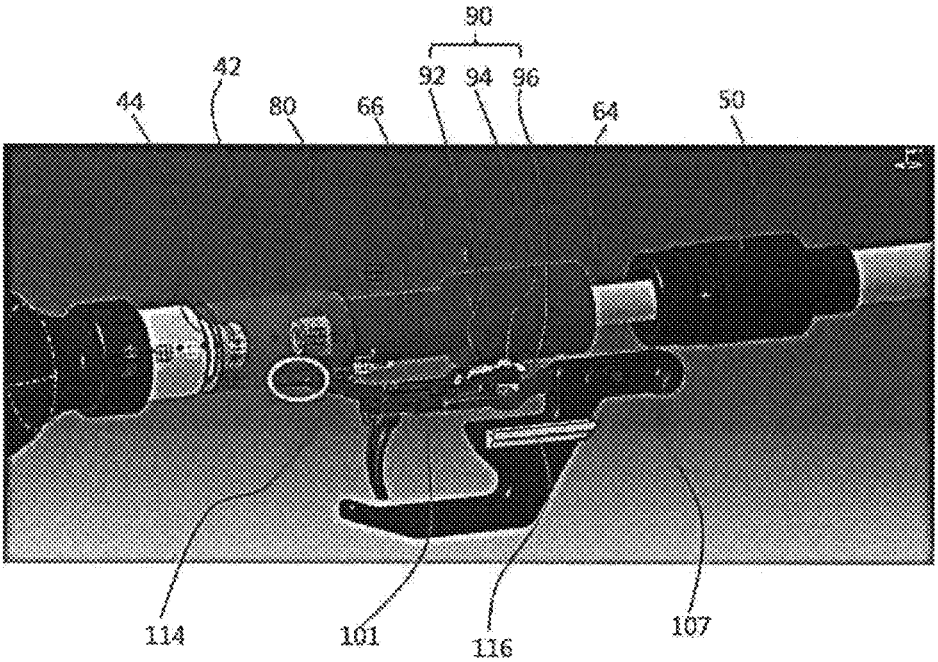
FIG. 5 is a view showing a state at the moment that the compressed air gun discharges according to the preferred embodiment of the present invention.
Figure 6:
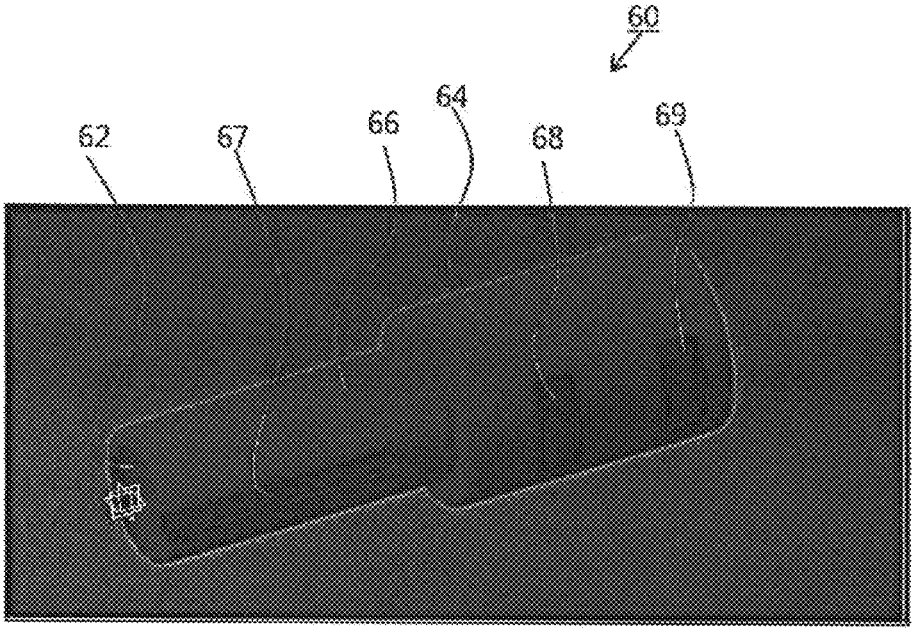
FIG. 6 is a perspective view showing a structure of the hammer part according to the preferred embodiment of the present invention.

For this, as shown in FIGS. 5 and 6, the hammer part 60 may include a hammer body 64, a small diameter part 66 and a latch insertion groove 68. First, the hammer body 64 forms a general outward appearance of the hammer part 60 according to the preferred embodiment of the present invention, and penetrates the hammer body 64 in the lengthwise direction to form a barrel hole 62.

Next, as shown in FIG. 6, the small diameter part 66 is formed by the barrel hole 62 extended to the rear end of the hammer body 64 and has a diameter smaller than that of the hammer body 64 so that the hammer moving part 80 is fit onto the hammer body 64 to be able to move slidably. That is, the small diameter part 66 rearward extends to the hammer body 64 and has the diameter smaller than that of the hammer body 64, and the barrel hole 62 is formed in the same way as the small diameter part 66. As shown in FIG. 5, the small diameter part 66 is inserted into a through hole of the hammer moving part 80 which will be described later.

Next, as shown in FIG. 6, the latch insertion groove 68 is engraved in the lower side of the hammer body 64 and an end of the latch part 90 is inserted into the latch insertion groove 68 to prevent movement of the hammer part 60. In addition, a retaining groove 69 may be formed in front of the latch insertion groove 68 to be spaced apart from the latch insertion groove 68 at a predetermined interval. The retaining groove 69 is to fix the hammer part 60 in the state where it is spaced apart from the valve body 42 at a predetermined interval while the compressed-air cylinder 30 is charged with air. In this instance, because the hammer part 60 does not reverse to a sufficient position and does not have a great power, even though the trigger is pulled by mistake to strike the valve collar 44, the blocking part does not operate.

Moreover, a sliding groove 67 may be formed on the bottom side of the small diameter part 66 so that an end of a connection driving part 114 can move without interference.

Figure 8:
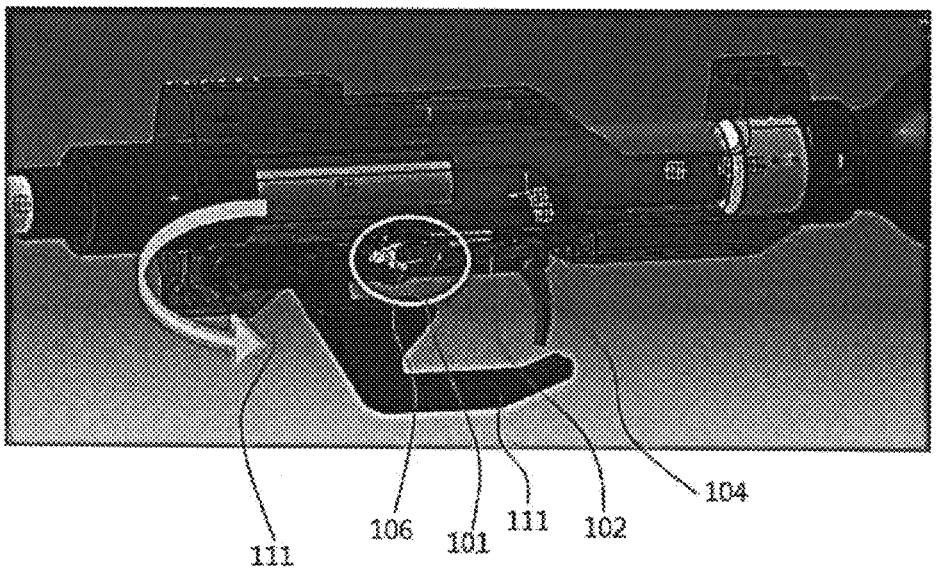
FIG. 8 is a view showing a state of the loading lever part at a discharge position according to the preferred embodiment of the present invention.

In the meantime, as shown in FIG. 8, the small diameter part 66 is formed to surround the outside of the front end of the valve body 42. Therefore, it is preferable that the diameter of the barrel hole 62 have the size that the valve body and the small diameter part 66 come into contact with each other as much as possible in the state where the small diameter part 66 surrounds the front end of the valve body 42 so as to minimize outflow of the compressed air.

Next, as shown in FIG. 1, the spring 70 is mounted between the hammer part 60 and the barrel holder 50 to press the hammer part 60 in the direction of the valve part 40. That is, the spring 70 provides a power to propel the hammer part 60 in the direction of the valve part 40 in order to strike the valve collar 44 with a strong power. Therefore, in this embodiment, it is preferable that the spring 70 have very strong elasticity and be mounted to surround the gun barrel 20 between the hammer part 60 and the barrel holder 50.

Figure 2:
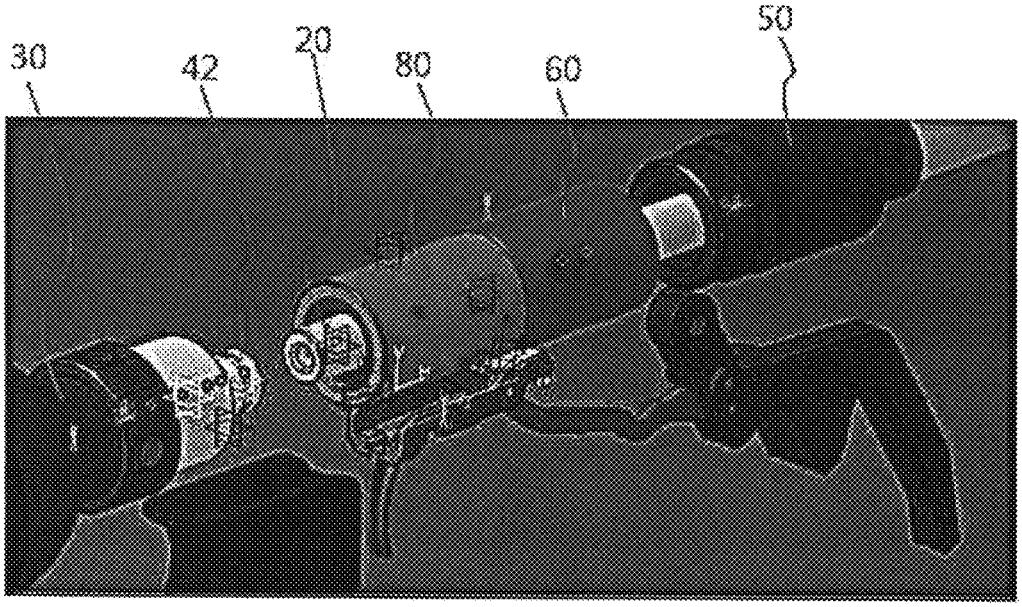
FIGS. 2 to 4 are views showing structures of a valve part, a hammer moving part and a hammer part according to the preferred embodiment of the present invention.

Next, as shown in FIG. 1, the hammer moving part 80 is mounted at the rear end of the hammer part 60 to be able to slide in order to push the hammer part 60 in the direction of the barrel holder 50. That is, as shown in FIG. 2, the hammer moving part 80 is inserted and mounted in the form to surround the outer face of the small diameter part 66 and slides along the small diameter part 66. Furthermore, the hammer moving part 80 gets in contact with the rear side of the hammer body 64 to push the hammer part 60 in the direction of the barrel holder 50 to compress the spring 70.

Therefore, as shown in FIG. 2, the hammer moving part 80 has a through hole which has an inner diameter of the size to be fit onto the outer face of the small diameter part 62.

Next, as shown in FIGS. 1 and 5, the latch part 90 is mounted on the air gun body 10 to prevent movement of the hammer part 60 in a state where the hammer part 60 is moved to the loading position. That is, when the hammer part 60 is moved to the loading part while compressing the spring, the latch part 90 blocks the movement of the hammer part 60 in the direction of the valve part 40 using the latch insertion groove 68, and makes the gun fire by releasing the blocking action by the action of the trigger part 100.

Therefore, as shown in FIG. 5, the latch part 90 may include a latch plate 92, a blocking head 94, a pressed part 96 and elasticity means (not shown). First, as shown in FIG. 5, the latch plate 92 is rotatably joined to the trigger part 100. Furthermore, the blocking head 94 protrudes upward from the upper side of the latch plate 92 and is inserted into the latch insertion groove 68.

Next, as shown in FIG. 5, the pressed part 96 is formed on the lower side of the latch plate 92 to be pressed by a pressing head 106. When the pressed part 96 is pressed by the pressing head 106, the hammer part 60 is released from the fixed state while the latch plate 92 and the blocking head 94 move downwardly.

Next, the elasticity means is mounted at the latch plate 92 to press the latch plate 92 to return to a blocking position whenever an external force does not exist. Therefore, due to the existence of the elasticity means, if the pressing head 106 does not press the pressed part 96 downwardly, the blocking head 94 always keeps the upwardly protruding state.

Meanwhile, in this embodiment, it is preferable that the latch part 90 further include a safety lever 98 which is formed on a side of the latch plate 92 opposed to the blocking head 94 to restrict a rotational operation of the trigger plate 102. The safety lever 98 may be separated from the latch part 90 to be mounted independently. The operation mechanism of the safety lever 98 will be described together with the trigger part 100.

Next, as shown in FIG. 1, the trigger part 100 is mounted on the air gun body 10 and presses the latch part 90 to release the blocked state of the hammer part 60. Here, as shown in FIG. 8, the 'blocked state' means that the spring 70 is compressed to the maximum and the latch insertion groove 68 is caught to the blocking head 94 not to be moved in the direction of the valve part 40 when the hammer part 60 moves in the direction of the barrel holder 50 as much as possible. Therefore, the trigger part 100 moves the blocking head 94 downwardly to make the hammer part 60 move in the direction of the valve part 40 by elasticity of the spring 70.

For this, in this embodiment, the trigger part 100 may include a trigger plate 102, a trigger 104 and a pressing head 106. First, as shown in FIG. 12, the trigger plate 102 is rotatably mounted on a trigger rotary shaft 101 which is mounted near to a lever rotary shaft 111, and as shown in FIG. 11, diverges into right and left sides so that a driving part mounting hole 103 is formed at the center.

Figure 11:
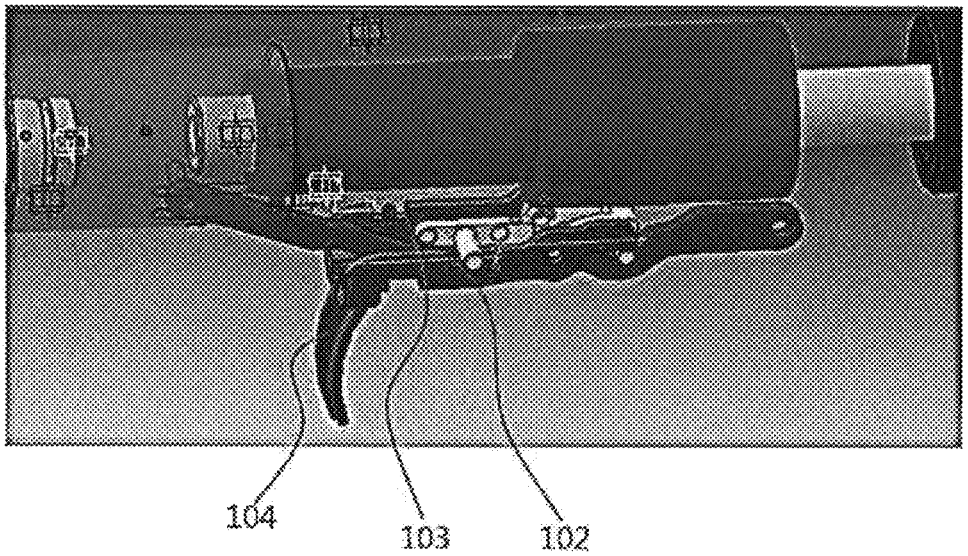
Figure 12:
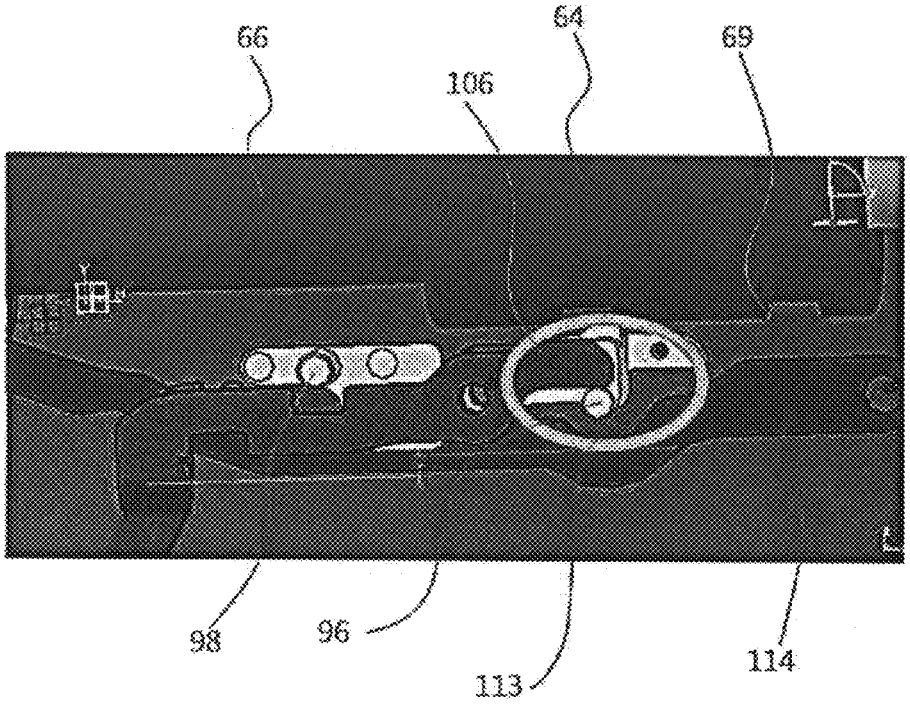
FIG. 12 is a view showing states of the trigger part and the latch part at the loading position.

The connection driving part 114 is mounted through the driving part mounting hole 103, and in the mounted state, as shown in FIGS. 11 and 12, a space in which the connection driving part 114 can be operated sufficiently is provided.

Next, as shown in FIG. 11, the trigger 104 is fixed and mounted at the rear end of the trigger plate 102 and serves to rotate the trigger plate and the pressing head downwardly by virtue of an action that a user pulls it with the fingers.

Next, as shown in FIGS. 11 and 12, the pressing head 106 is fixed and mounted at an end of the trigger plate 102 which is opposed to the trigger 104, and lowers by a pulling action of the trigger 104 to press the pressed part 96 of the latch part 90 downwardly.

In this instance, the trigger plate 102 and the latch plate 92 rotate on the same rotary shaft.

Figure 13:
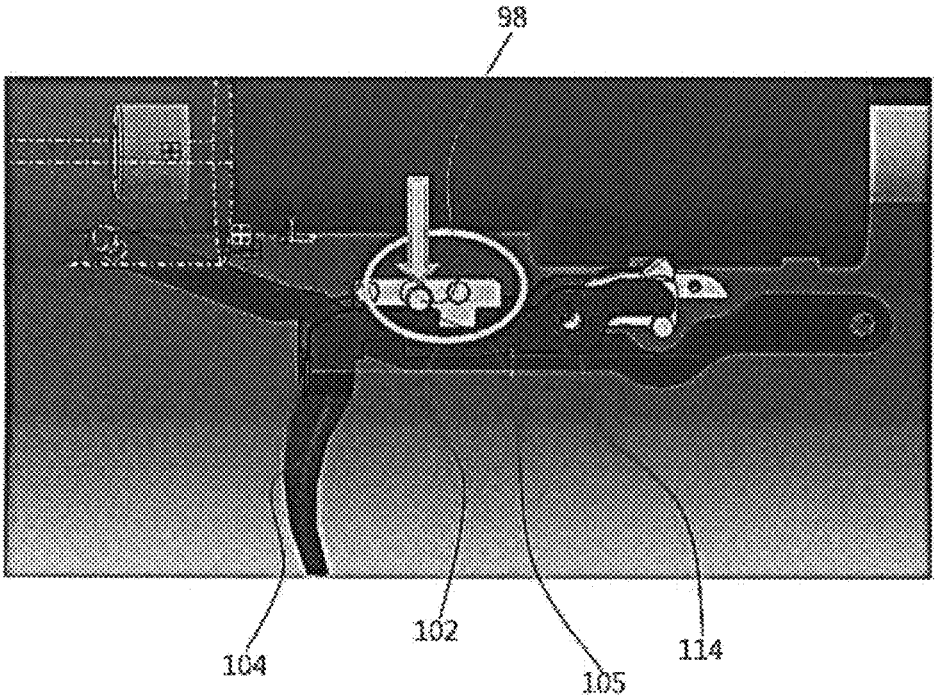
FIG. 13 is a view showing an operational state of a safety lever according to the preferred embodiment of the present invention.

Moreover, as shown in FIG. 13, the safety lever 98 protrudes laterally. Accordingly, the safety lever 98 allows rotation of the trigger plate 102 when the safety lever 98 is located in a discharge groove 105 of the trigger plate 102, but comes into contact with the upper side of the trigger plate 102 to prevent movement of the trigger plate 102 when the safety lever 98 moves to get out of the discharge groove 105. Therefore, even though the user pulls the trigger 104, because the pressing head 96 does not move, the gun does not fire and keeps a safe state.

Next, as shown in FIG. 1, the loading lever part 110 is joined with the hammer moving part 80 to slidably move the hammer moving part 80 to the loading position and the discharge position. Here, the 'loading position' means the position that the blocking head 94 is inserted into the latch insertion groove 68 when the hammer moving part 80 pushes the hammer part 60 in the direction of the barrel holder 50. In the meantime, as shown in FIG. 11, the 'discharge position' means the position that the hammer part 60 can freely move in the direction of the valve part 40 when the hammer moving part 80 moves in the direction of the valve part 40.

That is, after the hammer part is moved in a loaded state by a medium of the hammer moving part 80, the loading lever part 110 moves the hammer moving part 80 in the state where it gets in contact with the valve part 40 not to prevent a discharge action.

Figure 7:
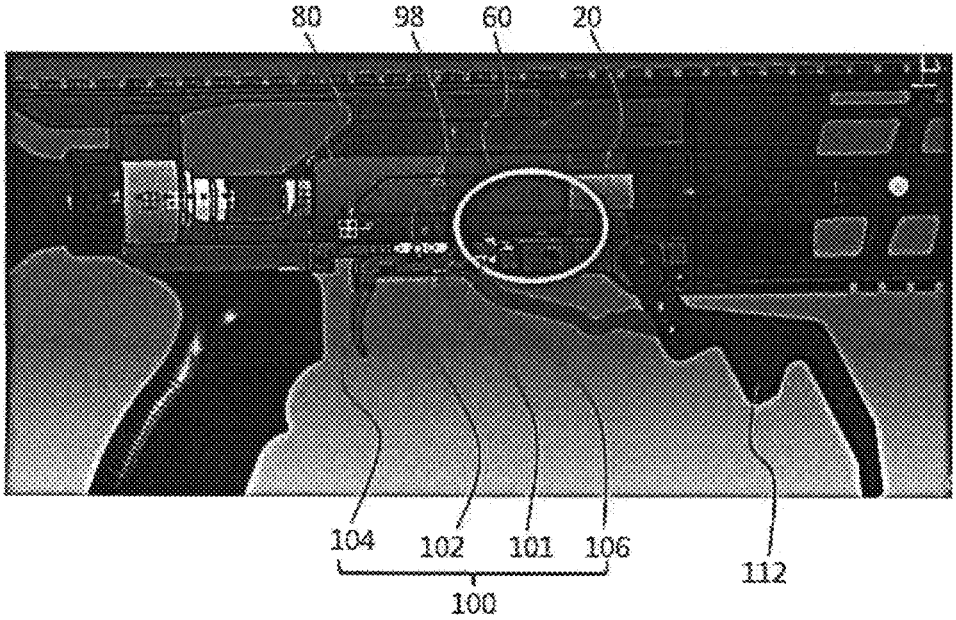
FIG. 7 is a view showing a state of a loading lever part at a loading position according to the preferred embodiment of the present invention.

For this, as shown in FIG. 7, the loading lever part 110 may include a rotary lever 112 and the connection driving part 114. First, as shown in FIG. 7, the rotary lever 112 is mounted at the lower part of the air gun body 10 to rotate on the lever rotary shaft 111 and has a handgrip structure enabling the user to easily grasp with the hand.

Next, as shown in FIG. 7, the connection driving part 114 is connected with the rotary lever 112 and the lower part of the hammer moving part 80, and moves the hammer moving part 80 to the loading position and the discharge position by virtue of the rotational operation of the rotary lever 112. In this instance, it is preferable that the connection driving part 114 be joined to a part of the rotary lever 112 which is close to the lever rotary shaft 111. Therefore, because an end of the rotary lever 112 serves as a lever, the connection driving part 114 and the hammer moving part 80 joined to the connection driving part 114 can be moved in the direction of the barrel holder 50 with a little power.

Figure 9:
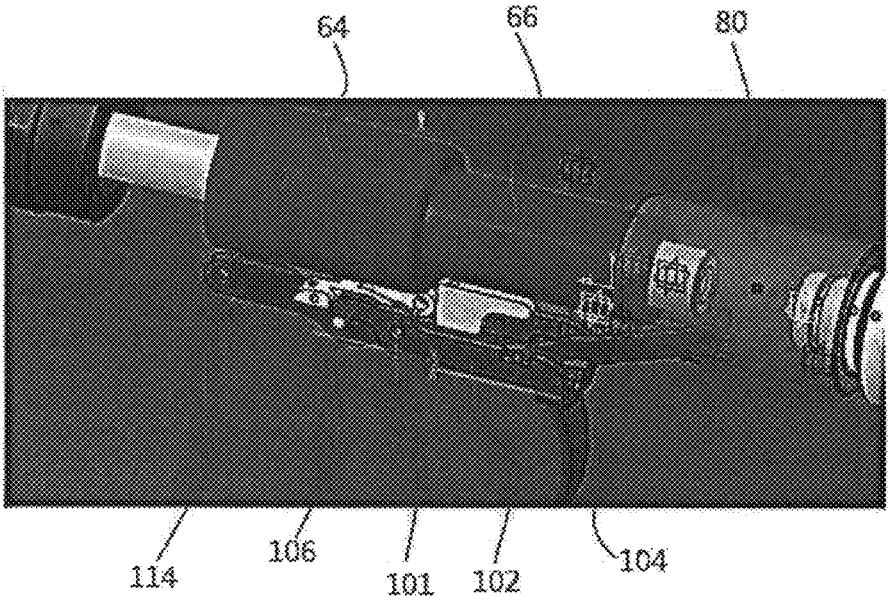
FIGS. 9 to 11 are views showing states of a trigger part and a latch part at the loading position.
Figure 10:
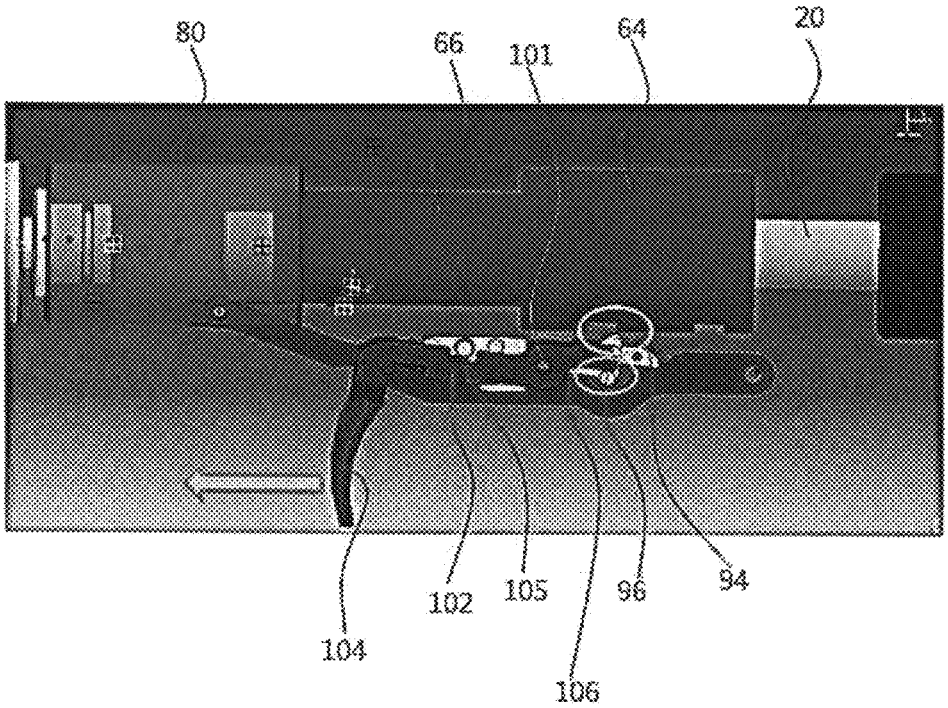

Additionally, as shown in FIGS. 9 and 11, the other end of the connection driving part 114 is rotatably joined to the lower part of the hammer moving part 80. Therefore, by virtue of the connection driving part 114, a rotary motion of the rotary lever 112 is converted into a linear motion of the hammer moving part 80 to make loading possible.

Figure 14:
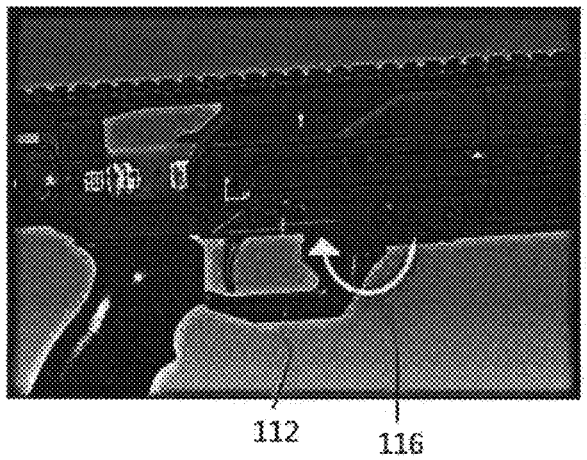
FIG. 14 is a view showing an operational state of an automatic locking lever according to the preferred embodiment of the present invention.
Figure 14:
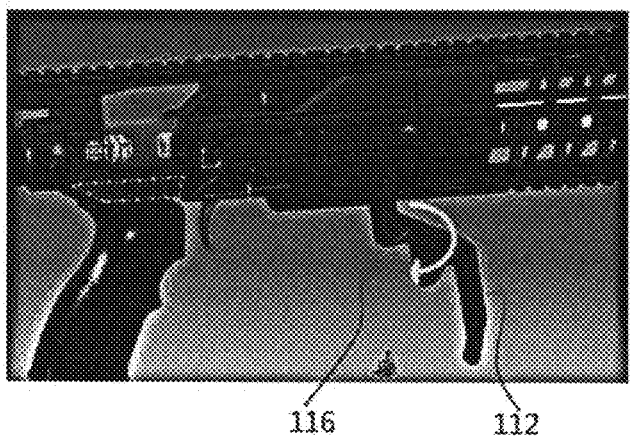
Figure 14:
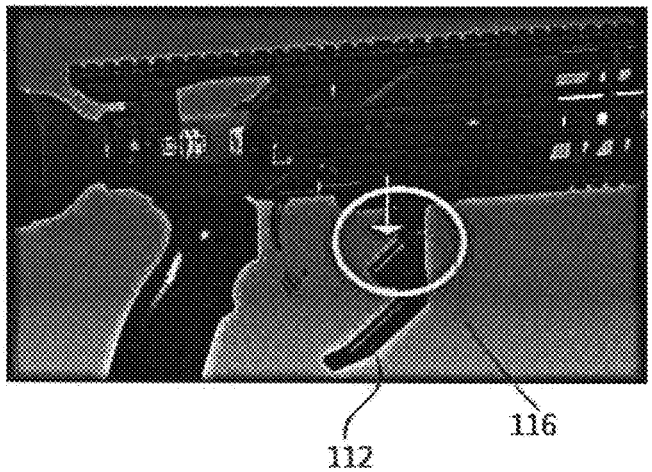

In the meantime, in this embodiment, as shown in (a) of FIG. 14, the loading lever part 110 may further include an automatic locking lever 116. The automatic locking lever 116 is rotatably mounted on the rotary lever 112, and as shown in (c) of FIG. 14, serves an automatic locking function by preventing rotation from the loading position of the rotary lever 112 to the discharge position while the user bends the rotary lever 112 back and returns it to the original position.

Of course, if the user rotates the automatic locking lever 116 as shown in (a) of FIG. 14, the automatic locking lever 116 can be moved to the discharge position.

What is claimed is:

1. A direct spray compressed air gun comprising:

an air gun body (10) which has a handgrip (12) mounted at the lower part thereof;

a gun barrel (20) which is mounted at the front side of the air gun body (10);

a compressed-air cylinder (30) which is mounted at the rear side of the air gun body (10) to store compressed air;

a valve part (40) which is spaced apart from the rear end of the gun barrel (20) at a predetermined interval to spray the fixed quantity of the compressed air stored in the compressed-air cylinder (30) in the direction of the gun barrel by an external impact;

a barrel holder (50) for fixing the gun barrel (20) to the air gun body (10) in such a way that a part of the rear end of the gun barrel (20) is exposed;

a hammer part (60) which is inserted into the rear end part of the gun barrel (20) and mounted to slide along the gun barrel (20), and which applies impact to the valve part (40) to spray the compressed air and blocks a space between the valve part (40) and the gun barrel (20) to guide the compressed air to move in the direction of the gun barrel (20);

a spring (70) which is mounted between the hammer part (60) and the barrel holder (50) to press the hammer part (60) in the direction of the valve part (40);

a hammer moving part (80) which is mounted at the rear end of the hammer part (60) to be able to slide and pushes the hammer part (60) in the direction of the barrel holder (50);

a latch part (90) which is mounted on the air gun body (10) to block movement of the hammer part (60) in a state where the hammer part (60) is moved in a loading position;

a trigger part (100) which is mounted on the air gun body (10) and presses the latch part (90) to release the blocked state of the hammer part (60); and a loading lever part (110) which is joined with the hammer moving part (80) to make the hammer moving part (80) slide to the loading position and a discharge position.

2. The direct spray type compressed air gun according to claim 1, wherein the valve part (40) comprises:

a valve body (42) which is mounted at an inlet of the compressed-air cylinder (30) and has a spray tube of a predetermined length in the direction of the gun barrel;

a blocking part which is mounted inside the valve body (42) to block an inner diameter of the valve body (42); and a valve collar (44) which is mounted at the rear end of the valve body (42) and reverses by an external impact to temporarily open the blocking part.

3. The direct spray type compressed air gun according to claim 2, wherein the hammer part (60) comprises:

a cylindrical hammer body (64) having a barrel hole (62) formed at the center thereof;

a small diameter part (66) which is formed by the barrel hole (62) extended to the rear end of the hammer body (64) and has a diameter smaller than that of the hammer body (64), so that the hammer moving part (80) is fit onto the outside of the small diameter part (66) to be able to slide; and a latch insertion groove (68) which is engraved on the lower side of the hammer body (64) and to which an end of the latch part (90) is inserted to prevent movement of the hammer part (60).

4. The direct spray type compressed air gun according to claim 3, wherein a diameter of the barrel hole (62) has the size that the valve body (42) and the small diameter part (66) come into contact with each other as much as possible.

5. The direct spray type compressed air gun according to claim 3, wherein the hammer moving part (80) has a tubular shape having an inner diameter in which the small diameter part (62) is inserted.

6. The direct spray type compressed air gun according to claim 5, wherein the loading lever part (110) comprises:

a the rotary lever (112) which is mounted at the lower part of the air gun body (10) to rotate on the lever rotary shaft (111); and a connection driving part (114) which is connected with the rotary lever (112) and the lower part of the hammer moving part (80) and moves the hammer moving part (80) to the loading position and the discharge position by virtue of the rotational operation of the rotary lever (112).

7. The direct spray type compressed air gun according to claim 6, wherein the trigger part (100) comprises:

a trigger plate (102) which is rotatably mounted on a trigger rotary shaft (101) mounted near to a lever rotary shaft (111);

a trigger (104) which is fixed and mounted at the rear end of the trigger plate (102); and a pressing head (106) which is fixed and mounted at an end of the trigger plate (102) which is opposed to the trigger (104) and lowers by a pulling action of the trigger (104) to press the latch part (90).

8. The direct spray type compressed air gun according to claim 7, wherein a driving part mounting hole (103) is formed at the center of the trigger plate (102) to allow the connection driving part (114) to operate in the inserted state without interference.

9. The direct spray type compressed air gun according to claim 7, wherein the latch part (90) comprises:

a latch plate (92) rotatably connected to the trigger rotary shaft (101);

a blocking head (94) which is formed on the upper side of the latch plate (92) and is inserted into the latch insertion groove (68);

a pressed part (96) which is formed at the lower side of the latch plate (92) to be pressed by the pressing head (106); and an elasticity means which is mounted at the latch plate (92) to press the latch plate (92) whenever an external force does not exist.

10. The direct spray type compressed air gun according to claim 9, wherein the latch part (90) further comprises a safety lever (98) which is formed on a side of the latch plate (92) opposed to the blocking head (94) to restrict a rotational operation of the trigger plate (102).

11. The direct spray type compressed air gun according to claim 6, wherein the loading lever part (110) further comprises an automatic locking lever (116) which is rotatably mounted on the rotary lever (112) to prevent rotation from the loading position of the rotary lever (112) to the discharge position.

* * * * *